United States Patent [19]

Jones

[11] 3,991,423

[45] Nov. 16, 1976

[54] HELMET WITH ACTUATED NECK PAD

[75] Inventor: Richard F. Jones, Santa Barbara, Calif.

[73] Assignee: General Aquadyne, Inc., Santa Barbara, Calif.

[22] Filed: Sept. 8, 1975

[21] Appl. No.: 610,915

[52] U.S. Cl. ..... 2/415

[51] Int. Cl.[2] ..... A63B 33/00

[58] Field of Search ..... 2/3 R, 2.1 R, 6, 3 A

[56] References Cited

UNITED STATES PATENTS

| | | | |
|---|---|---|---|
| 3,362,403 | 1/1968 | Fleming et al. | 2/6 X |
| 3,628,190 | 12/1971 | Molitoris | 2/3 A |
| 3,787,894 | 1/1974 | Goodman, Jr. | 2/3 A |

FOREIGN PATENTS OR APPLICATIONS

| | | | |
|---|---|---|---|
| 1,005,187 | 9/1965 | United Kingdom | 2/6 |

*Primary Examiner*—Werner H. Schroeder
*Assistant Examiner*—Peter Nerbun
*Attorney, Agent, or Firm*—Harry W. Brelsford

[57] ABSTRACT

A diver's helmet is held to his head by means of a movable pad which engages the back of the neck, preferably near the base of the skull. The pad is preferably manually movable by means of any suitable mechanism to engage the diver's neck.

1 Claim, 3 Drawing Figures

BOTTOM VIEW

HELMET WITH ACTUATED NECK PAD

My invention relates to rigid helmets for divers and has particular reference to an actuated neck pad for securing the helmet to the head of the diver.

Current diving practice employs face masks for supplying breathing gas to the nose and mouth of the diver. The face mask is independent of the suit worn by the diver, which may be a wet or dry suit. The diver requires, however, a protective helmet for the rest of his head, and this helmet may be wet or dry also, that is, the ambient water may be present inside the helmet of may be excluded from the helmet. In both types of helmets, the fastening of the helmet to the diver's head has been a problem. Preferably, the helmet must be so constructed that it moves freely with the diver's head.

Some helmets have been secured to the face mask and the face mask in turn secured to the diver's head by elastic straps, generally in the shape of a spider. This fastening means has met with objections in that violent currents can overcome the strength of the elastic spider and knock the helmet and face mask off the diver's head. Violent tidal currents can cause such an accident, and unintentional blasts from jetting hoses can also cause this effect. Another attempt to solve this helmet-retention problem has been the custom-fitting of pads inside the helmet to fit the particular head size and head shape of the diver for which it is constructed. These are objectionable in that helmets are no longer interchangeable and retention on the diver's head is far from certain.

In summary, my improvement employs a movable neck pad that engages the base of the skull of the diver at the back of his neck. The neck opening of the helmet is made large enough for various sizes of heads. The neck pad is positioned against the inside of the helmet shell so that the shell can be placed over the diver's head. Thereafter, any suitable manually operated mechanism can be used to move the pad to the diver's neck to thereby press the diver's face against the oval outline of the face seal of the mask. When the diver's head is thus secured fore and aft the helmet is securely locked to the diver's head and even upside-down maneuvers by the diver will not cause it to come off. A suitable neck seal secured to the bottom edge of the helmet prevents loss of air from the interior of the helmet when the diver leans over or when he is upside down.

Various objects, advantages, and features of the invention will be apparent in the following descriptions and claims considered together with the accompanying drawing forming an integral part of this specification and in which:

Figure 1:
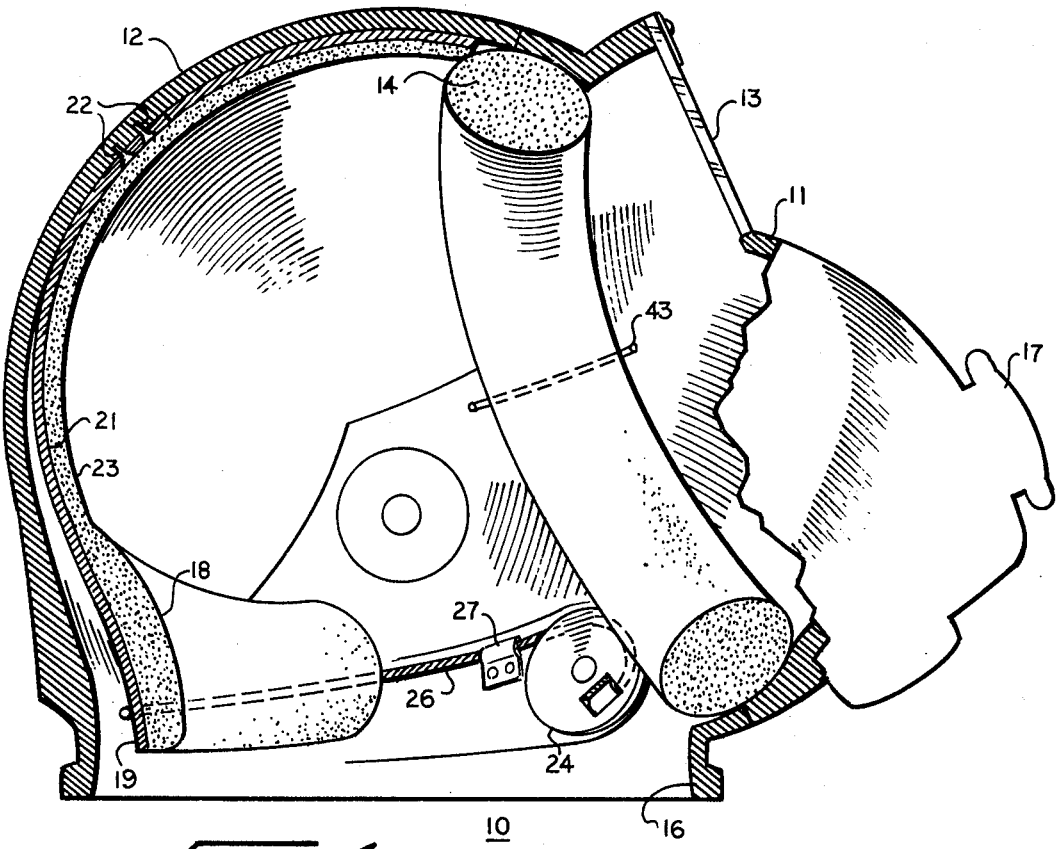
FIG. 1 is an elevation view in full section showing a combined face mask and helmet employing the neck band of the invention.

Referring to the drawings, a diver's headgear 10 includes a face mask 11 and a helmet 12 secured together in any suitable fashion as by rivets, adhesive, or any other suitable fasteners. The face mask employs the usual window 13 and a generally oval-shaped face seal 14. The helmet 12 has a neck opening 16 through which the diver's head is inserted and thereafter his face engages the face seal 14. The face mask 11 may have the usual regulators indicated generally by 17 to supply a breathing gas to the diver at a pressure just slightly higher than the ambient hydrostatic pressure in which the diver is working.

Provided particularly in accordance with the invention is a neck pad having a soft sponge inner surface 18 and a hard outer shell 19, which may be formed of any resilient material such as plastic reinforced with fiberglass. Projecting upwardly from the padding 18 is a resilient spring member 21, which is riveted or otherwise secured to the interior of the helmet at 22. Preferably the inner side of this spring member 21 is padded with padding 23. The spring member 21 may be integrally formed with the shell 19 of the pad and may be normally biased to move the shell 19 and its sponge pad 18 to the left as viewed in FIG. 1.

This neck pad 18–19 may be moved toward the face mask 11 by any suitable mechanism, preferably manually operated, and there is illustrated a presently preferred mechanism in the form of a windlass 24, which winds in or lets out a flexible metal cable 26. The cable 26 may be guided in a slide 27 adjacent to the windlass 24.

Figure 2:
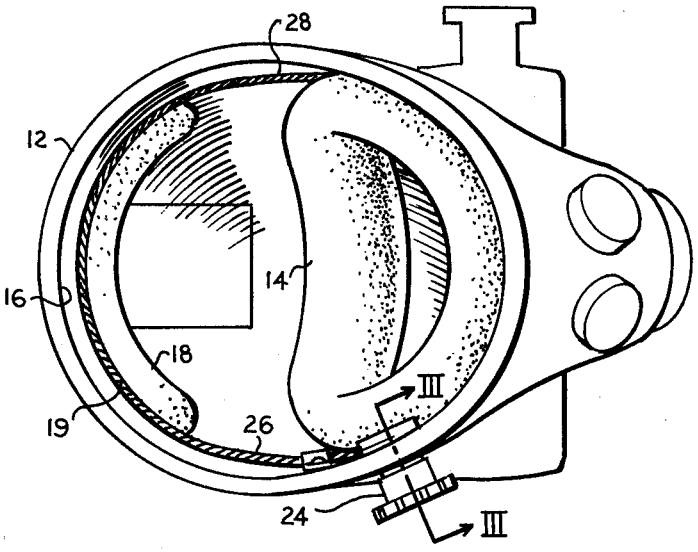
FIG. 2 is a bottom view on a reduced scale of the helmet and face mask of FIG. 1.

As viewed best in FIG. 2, the cable 26 may be anchored at one end at 28 and the other end may be wound on the windlass 24.

Figure 3:
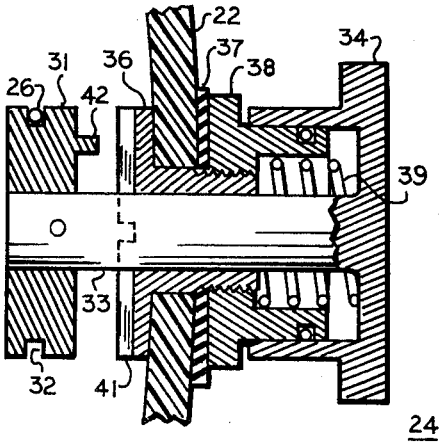
FIG. 3 is an elevation view in full section on an enlarged scale of the hand windlass of the invention taken along the line of III—III of FIG. 2.

Any suitable mechanism may be employed for moving the pad 18–19 toward the face mask 11, and that illustrated in detail in FIG. 3 is merely a presently preferred embodiment of a windlass. The windlass 24 includes a rotatable drum 31 having a notch 32 in which is disposed one end of the cable 26, and this drum is rotated by a shaft 33, which on its outer end has a manual handle 34. The shaft 33 is rotatable and slidable longitudinally in a bushing 36 disposed in the side wall of the helmet 22 and sealed therein by a gasket 37 and a compression washer 38. A compression spring 39 normally urges the shaft 33, its handle 34, and the windlass drum 31 to the right as viewed in FIG. 3. Formed on the inner end of the bushing 36 is a plurality of radial slots 41, any one of which can be engaged by a pin 42 formed on the drum 31 and projecting toward the bushing 36.

In operating the manual windlass of FIG. 3, the diver grasps the handle 34 and shoves it toward the left against the compression spring 39 and FIG. 3 shows the shaft 33 moved toward the left. In that position the drum pin 42 disengages from the stationary slots 41 and thereupon is free to rotate by the manual turning of the handle or knob 34. Rotation in one direction will tighten up on the cable 26 to move the neck pad 18–19 toward the face mask 11. Rotation in the opposite direction will allow the spring 21 to move the neck pad 18–19 to the left as viewed in FIG. 1, because of the spring action of the spring 21.

In operating the entire headgear consisting of the face mask 11 and the helmet 12, the pad 18–19 is moved to the left as viewed in FIG. 1 so that the diver may have enough clearance at the neck opening 16 to place the head gear over his head until his face engages the face mask seal 14. The diver then operates the hand windlass 24 as just described to pull the neck pad 18–19 to the right as viewed in FIG. 1. The neck of the diver is thus engaged at the base of the skull, and the face of the diver is shoved into the face seal 14. The helmet and face mask are thereby securely fastened to the head of the diver, but with a comfortable resilient type of fastening. The diver can then lean over or indeed assume an upside-down position, and there will be no movement of the face mask and helmet with relation to his head.

In normal usage a neck air seal (not shown) engages the neck opening 16 of the helmet to prevent escape of air inside the helmet as the diver leans over or maneuvers in upside-down position.

The helmet 12 may be either a dry helmet with air inside or a wet helmet. If utilized as a dry helmet, it is preferable to equalize the air pressure between the interior of the face mask and the interior of the helmet, and for this purpose a small tube 43 may pass through or underneath the face seal 14. In this fashion there will be no differential pressure acting on the diver's ears to cause him distress. When used as a wet helmet, the tube 43 is omitted or closed and the helmet 12 is normally perforated for free movement of water. When used as a dry helmet, there will be considerable buoyancy due to the air inside the helmet, and this is counteracted normally by weighting the helmet with lead shot or other suitable weights. The entire interior of the helmet is preferably lined with a cushion material such as rubber foam.

To remove the helmet, the diver grasps the handle 34 of FIG. 3 and shoves it inwardly against the compression of spring 39 as illustrated in FIG. 3, whereupon the spring action of the pad spring 21 pulls the cable 26 outwardly on the windlass, and this is assisted by the diver rotating it in the opposite direction. Once the neck pad 18–19 is close to the rear of the helmet, then the diver can easily lift the helmet and face mask off his head.

It will be obvious to those skilled in the art that various modifications may be made in the device. For example, the neck pad and windlass device could be used to hold a face mask on the diver's head regardless of the presence of a helmet. Furthermore, the neck pad can be used to hold helmets on a diver's head whether or not a face mask is present. Various devices can be used to move the neck pad 18–19 toward and away from the diver's head. The spring 21 could be biased to shove the pad against the diver's neck or head. I prefer at present, however, to use a mechanical device inasmuch as it is more positive in its locking action in holding the helmet and face mask to the diver's head. All modifications and variations that fall within the true spirit and scope of the invention are included within the scope of the following claims.

I claim:

1. Diving gear for the head of a diver comprising:

a. a face mask;

b. a rigid helmet secured to the face mask to enclose the head of a diver and having a neck opening;

c. a neck pad on the interior of the helmet adjacent to the neck opening opposite the face mask;

d. a leaf spring having one end connected to the neck pad and extending vertically therefrom and having the other end secured to the interior of the helmet and normally biasing the neck pad against the interior of the helmet and away from the face mask characterized by having a shape that normally fits snugly against the interior of the helmet;

e. and manually operable means of moving the neck pad toward the face plate to thereby engage the neck of the diver to hold the helmet and face mask in place on the diver's head, whereby the pad has a maximum amount of retraction when said manually operable means is released, so that the neck opening is of maximum size for easy placement on or removal from the diver's head.

* * * * *